United States Patent [19]

Mizota

[11] Patent Number: 4,582,110

[45] Date of Patent: Apr. 15, 1986

[54] ELECTROMAGNETIC STIRRING MOLD FOR CONTINUOUSLY CAST BLOOMS

[75] Inventor: Hisakazu Mizota, Kurashiki, Japan

[73] Assignee: Kawasaki Steel Corporation, Kobe, Japan

[21] Appl. No.: 580,147

[22] Filed: Feb. 14, 1984

[30] Foreign Application Priority Data

Feb. 17, 1983 [JP] Japan ..... 58-25374

[51] Int. Cl.[4] ..... B22D 11/04; B22D 11/124; B22D 27/02; B22D 27/04

[52] U.S. Cl. ..... 164/504; 164/416; 164/443

[58] Field of Search ..... 164/504, 468, 418, 443, 164/416, 485, 478

[56] References Cited

U.S. PATENT DOCUMENTS 4,178,979 12/1979 Birat et al. ..... 164/504 X 4,239,078 12/1980 Tarmann ..... 164/504

*Primary Examiner*—Francis S. Husar

*Assistant Examiner*—Steve Katz

*Attorney, Agent, or Firm*—Balogh, Osann, Kramer, Dvorak, Genova & Traub

[57] ABSTRACT

An electromagnetic stirring mold for the manufacture of continuously cast bloom, which includes a copper plate constituting a water-cooling type mold, a backup frame, a mold frame and an electromagnetic stirrer. In this mold, water-cooling passages are defined between the copper plate and the backup frame and between the backup frame and the mold frame, respectively, which are communicated at their upper parts to water supply and discharge passages located in the upper part of the mold frame, whereby a mounting space for the electromagnetic stirrer is sufficiently formed down below the lower part of the mold frame.

5 Claims, 5 Drawing Figures

ELECTROMAGNETIC STIRRING MOLD FOR CONTINUOUSLY CAST BLOOMS

This invention relates to an electromagnetic stirring mold for the manufacture of continuously cast bloom, and more particularly to an improvement in the electromagnetic stirring mold which can advantageously perform the electromagnetic stirring of molten steel in the mold.

The electromagnetic stirring of molten steel in a water-cooled mold for continuous casting is applied for preventing bubble defects such as pin-hole, blow-hole and the like in a surface portion of a continuously cast slab as well as improving qualities of the slab based on the increase of equiaxed crystallization. Although the stirring system is not fixed, if it is intended to manufacture continuously cast bloom, the stirring of a horizontally turning flow by a rotating magnetic field system is usually performed in view of the stirring efficiency and effect.

The general construction for the above system is shown in FIGS. 1 and 2, wherein numeral 1 is molten steel, numeral 2 a copper plate of a water-cooled mold, numeral 3 a backup frame, numeral 4 a mold frame, numerals 5, 5' water-supply headers each arranged in the backup frame 3, numeral 6 a cooling water passage defined between the copper plate 2 and the backup frame 3, numerals 7, 7' water supply and discharge ducts formed in the mold frame 4 and separated from each other, numerals 8, 9 an electromagnetic coil and an iron core frame for a field-rotating type stirrer, respectively, numeral 10 a foot roller, numeral 11 a direction of stirring flow, and numeral 12 an oscillation table.

In case of the stirring of a horizontally turning flow, the field-rotating type stirrer is constructed with the electromagnetic coils 8 and the iron core frame 9 and is arranged behind the backup frame 3. Thus, the rotating magnetic field is produced as a magnetic field, whereby the molten steel 1 in the mold is subjected to a turning movement in the arrow direction 11.

Since the electromagnetic force generated from the electromagnetic coil 8 is attenuated by the copper plate 2 and the backup frame 3, in order to raise the stirring force, it is preferable to make the thickness of the plate 2 and the frame 3 as small or minimal as possible. Also, it is necessary that the space housing the stirrer is made large to increase the current capacity of the coil.

In the ordinary mold for the continuously cast bloom, however, the cooling of the copper plate 2 is carried out by passing cooling water through the water supply and discharge ducts 7, 7' which are isolated up and down in the mold frame 4 as shown in FIG. 2. Therefore, when the field-rotating type stirrer for stirring molten steel is incorporated into the mold, it is unavoidable for it to be placed in a narrow space 13 defined by the water supply and discharge ducts 7, 7' and isolated up and down in the mold frame 4 and the backup frame 3 as shown in FIG. 2. As a result, in the case of the usual continuous casting mold, it is difficult to provide a desired stirring flow velocity (0.5 m/sec~1.0 m/sec) by a stirrer housed in such a space 13.

In order to widen the space housing the stirrer, it is proposed (considered) to raise the height of the mold or to extend the mold frame 4 outwardly. On the other hand, the bloom is small in size as compared with the slab, so that the rigidity of the solidification shell in the bloom is high. Therefore, in the manufacture of the bloom, even if the mold height is raised as described above, an air gap is produced at the lower portion of the mold, so that a problem is caused that the solidification shell does not follow the mold in accordance with the change of pouring conditions. As a result, the mold height is usually limited to about 700 mm at maximum. While the outward extension of the mold frame 4 is applicable to a newly-established caster to a certain degree, is not allowed due to the restriction on the position of the oscillation table 12 and other restrictions when such a frame 4 is incorporated into the existing caster.

As another means, it has been proposed that the shape of the mold be made tubular and the stirrer be miniaturized by extremely reducing the thickness of the copper plate and the backup frame and reducing the required current capacity of the electromagnetic coil. In this tubular mold, it is possible to produce a bloom of a small size (about 150 mmϕ or less), but when the size of the bloom exceeds 200 mmϕ, the deformation of the mold becomes larger, which frequently causes problems in view of the quality of the cast bloom and the life of the mold.

Under the above situations, if it is intended to put an electromagnetic stirring apparatus in the existing continuous casting mold, it is particularly difficult to design a stirring apparatus having the required capacity in view of its structure.

It is, therefore, an object of the invention to provide a structure of an electromagnetic stirring mold which ensures a space required for housing an electromagnetic stirrer at optimum conditions and provides a sufficient stirring capacity.

In the electromagnetic stirring mold according to the invention, a water-cooling passage defined between the backup frame and the mold frame is communicated at its upper portion to a water supply passage on one hand and at its lower portion to a water-cooling passage defined between the backup frame and the copper plate on the other hand, and the latter water-cooling passage is communicated at its upper portion to a water discharge passage, and a mounting space for an electromagnetic stirrer is formed down below the water supply and discharge passages.

The invention will now be described in detail with reference to the accompanying drawings, wherein.

Like parts are designated by like numerals throughout the different figures of the drawing.

Figure 1:
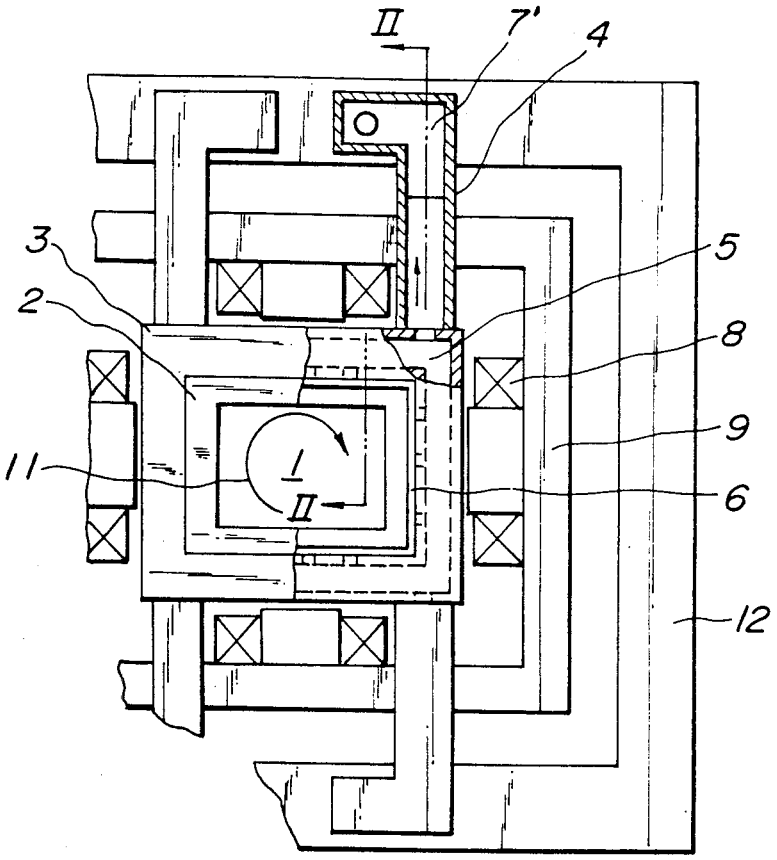
FIG. 1 PRIOR ART
FIG. 1 is a plan view partly shown in section of the conventional electromagnetic stirring mold as mentioned above.
Figure 2:
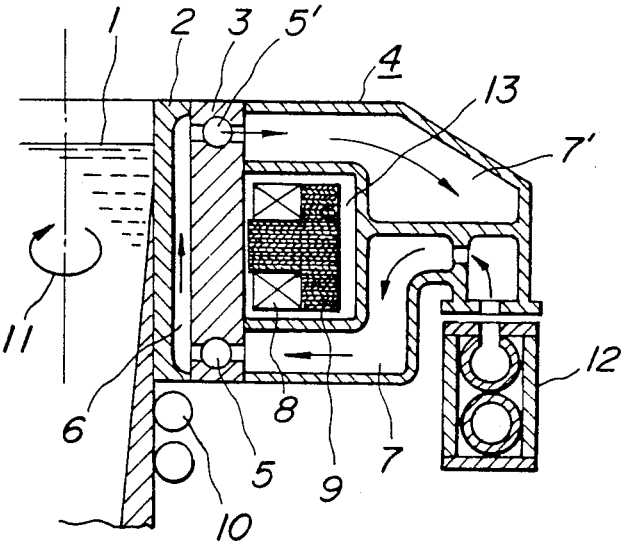
FIG. 2 PRIOR ART
FIG. 2 is a sectional view taken along a line II—II of FIG. 1.
Figure 3:
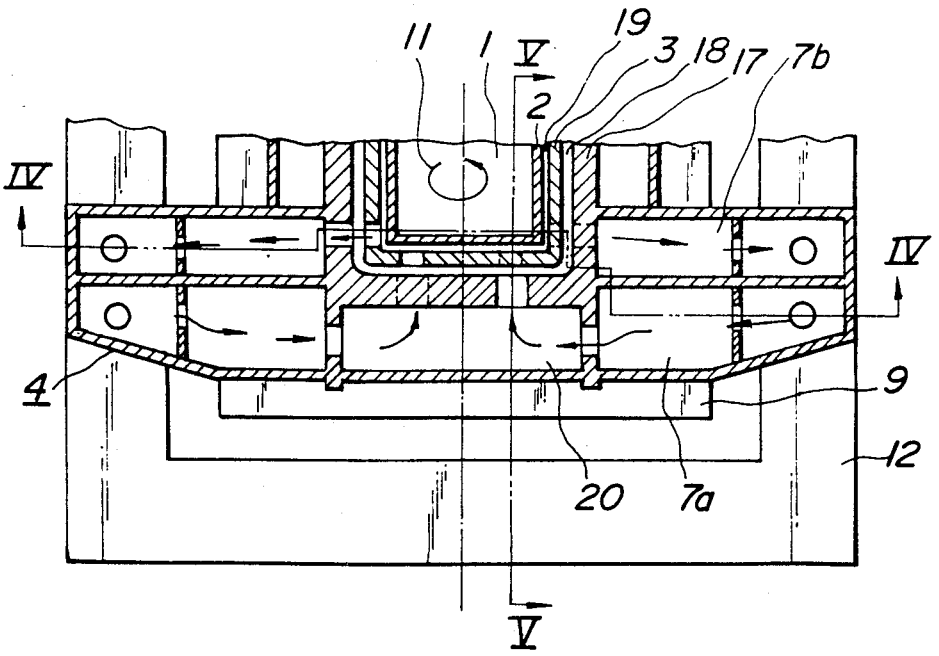
FIG. 3 is a partially plan view shown in section of an embodiment of the electromagnetic stirring mold according to the invention.
Figure 4:
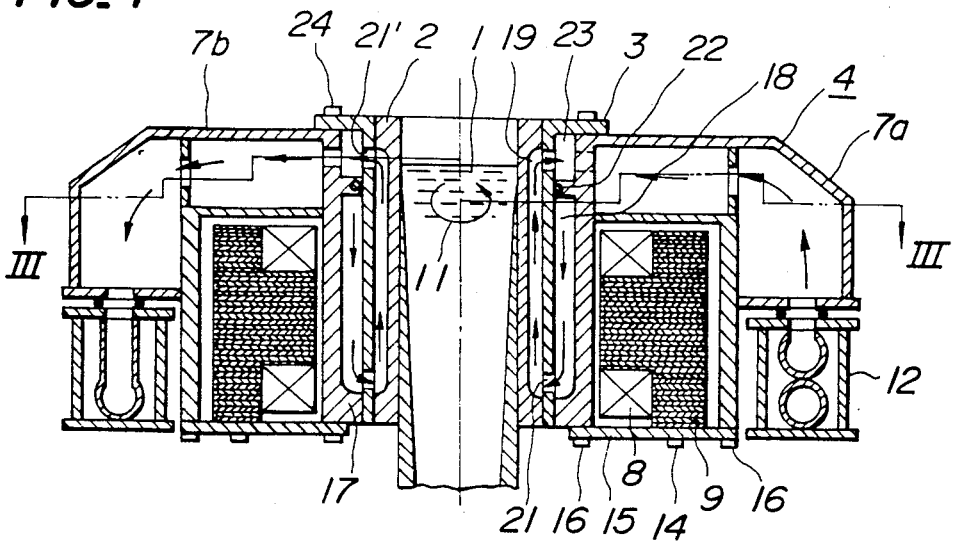
FIG. 4 is a sectional view taken along a line IV—IV of FIG. 3.
Figure 5:
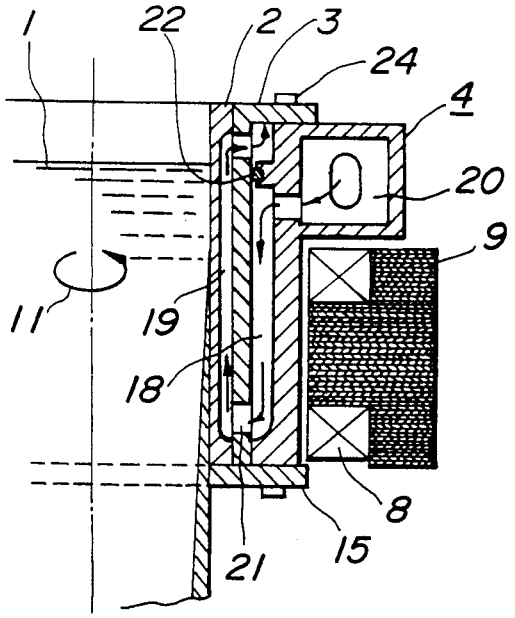
FIG. 5 is a sectional view taken along a line V—V of FIG. 3.

In the embodiment of FIGS. 3 to 5, when molten steel 1 is subjected to the stirring of a horizontally turning flow in an arrow direction 11, if strong stirring is carried out near the outer surface of molten steel, there is a fear of causing defects such as powder catching, slag inclusion and the like. As shown in FIG. 4, therefore, and electromagnetic coil 8 is preferable to be set aside to the lower part of the mold apart from the outer surface portion of molten steel. As a result, the upper part of the mold is effectively utilized as a space for structuring a mold frame 4, whereby a space for the coil 8 is left at the lower part of the mold as far as possible. When using electromagnetic coils of a rotating magnetic field system, an iron core frame 9 becomes square likewise the case of FIG. 1. Moreover, while the core frame 9 may be a split type, it is favored to be incorporated into the mold as an integral structure with the electromagnetic coils 8 in view of the difficulty (in the incorporation into the mold and the maintenance in the actual operation).

According to the invention, therefore, water supply passage *7a* and water discharge passage *7b* extending upward from an oscillation table 12 are disposed in the mold frame 4 side by side in a horizontal direction to form an open space below the lower part of the mold frame 4. Then, the integral structure of electromagnetic coils 8 and iron core frame 9 is inserted from the lower part of the mold frame into the space defined therein and fixed to the mold frame 4 through a flange 15, which is previously fixed to the bottom surface of the iron core frame 9 by means of bolts 14, with fitting bolts 16 as shown in FIG. 4. Thus, a wide space surrounded by the lower surfaces of the water supply and discharge passages *7a*, *7b* and the inner surface of the oscillation table 12 can effectively be utilized as a mounting space for the field-rotating type stirrer. Moreover, the reduction of frame rigidity due to the open structure in the lower part of the mold frame 4 is compensated not only by arranging a rigidity-reinforcing member on the upper part of the mold frame 4 but also by fixing the flange 15 to the lower surface of the frame 4 with bolts.

In the mold according to the invention, the backup frame 3 surrounding the copper plate 2 is further surrounded by a box-shaped member 17 (or a cylindrical member) formed inside the mold frame 4. According to the invention, water-cooling passages 18, 19 continuously extending in the peripheral direction are defined between the member 17 and the backup frame 3 and between the backup frame 3 and the copper plate 2, respectively. In this case, the water-cooling passage 18 is communicated at its upper portion to the water supply passage *7a* through a water supply header 20 provided on each side of the mold frame 4 at the upper part thereof as shown in FIGS. 3 and 5. The water-cooling passage 19 is communicated to the water-cooling passage 18 through openings 21 formed in the lower portion of the backup frame 3 on one hand and to a passage 23, which is defined by disposing a sealing material 22 between the backup frame 3 and the mold frame 4 above the passage 18, through openings 21' formed in the upper portion of the backup frame 3 and hence to the water discharge passage *7b* on the other hand. Thus, cooling water supplied from the oscillation table 12 flows from the water supply passage *7a* through the header 20 to the water-cooling passages 18, 19, whereat the cooling action is performed, and then it is discharged through the passage 23 and water discharge passage *7b* into the oscillation table 12.

Moreover, the water-cooling passages 18, 19 are constructed, for example, by fixing a top portion of the backup frame 3 previously fitted with the copper plate 2 to the upper surface of the mold frame 4 by means of bolts 24.

The backup frame 3 generates heat by an eddy current based on the electromagnetic action of the stirrer. According to the invention, however, a water cooling jacket is constructed with the water-cooling passages 18, 19, while the thickness of the frame 3 is sufficiently reduced, so that the backup frame 3 is not deformed by the generated heat.

As apparent from the above, according to the invention, it is possible to sufficiently cool the copper plate 2 without arranging water supply and discharge passages in the lower part of the mold frame 4. Further, since the header 20 is provided on each side of the mold frame 4 at the upper part thereof, the electromagnetic coil 8 is easily placed in the space below the mold frame 4 without being obstructed by the header 20, so that it is not placed away from the molten steel.

According to the invention, the basic structure of the mold itself follows that of the conventional one, so that even when it is applied to the existing continuous caster, the mounting space for the electromagnetic stirrer can be ensured to be at a maximum. Of course, it is also applicable to a newly-established continuous caster.

Moreover, the invention is particularly effective not only when using the field-rotating type stirrer of a rotary magnetic field system as an electromagnetic stirrer, but also when using a linear motor type coil. Although the fixing of the electromagnetic stirrer is carried out by fitting the iron core frame 9 to the flange 15 with bolts 14 in FIG. 4, the bearing of load by the flange 15 may be mitigated by suspending the upper part of the electromagnetic stirrer from the mold frame 4 as a modified embodiment.

Of course, the material of the mold parts located inside and near the electromagnetic stirrer must be of necessity a nonmagnetic material in order to prevent the attenuation of magnetic flux density applied to molten steel 1.

The merits of the invention are summarized as follows:

(1) The space for the electromagnetic stirrer is ensured sufficiently, so that the stirring capacity on molten steel can be made large as compared with that of the conventional system even in the case of the continuous casting mold having an insufficient space;

(2) The mold has a frame structure fundamentally following the conventional one as a plate-type solid structure, so that it is easily applicable to the existing continuous caster;

(3) The mechanical structure of the mold body and the structure of the electrical parts in the electromagnetic stirrer are separated from each other, so that the assembling is easy and the maintenance is good; and (4) Since there is no protrusion at the lower part of the mold, even if it is intended to reconstruct the existing continuous caster, it is hardly required to reconstruct the strand supporting mechanism below the lower part of the mold.

Further, the invention can be used as an electromagnetic stirring mold for the manufacture of square blooms as well as round blooms and other profile blooms.

What is claimed is:

1. In an electromagnetic stirring mold for the manufacture of continuously cast bloom comprising a copper plate for a water cooling type mold, a backup frame surrounding said copper plate and provided with upper and lower portions, a mold frame fitted to said backup frame having upper and lower portions, and provided with water supply and discharge passages, and an electromagnetic stirrer located behind said backup frame and composed of electromagnetic coils integral with an iron core frame to cause stirring flow of molten steel poured into said mold, the improvement wherein a first water-cooling passage defined between said backup frame and mold frame is communicated at its upper portion to said water supply passage on one hand and at its lower portion to a second water-cooling passage defined between said backup frame and copper plate on the other hand, and the second water-cooling passage is communicated at its upper portion to said water discharge passage, and a mounting space for said electromagnetic stirrer is formed in said mold frame down below said water supply and discharge passages, which space is isolated from said passages so as to facilitate disassembling said electromagnetic stirrer from a lower part of said mold.

2. An electromagnetic stirring mold according to claim 1, wherein said mold frame is provided on each side at the upper part thereof with a water supply header communicating said first water-cooling passage defined between the backup frame and the mold frame to said water supply passage.

3. An electromagnetic stirring mold according to claim 1, wherein said second water-cooling passage defined between the backup frame and the copper plate is communicated to said water discharge passage through a passage defined by disposing a sealing material between the backup frame and the mold frame at their upper portions.

4. The electromagnetic stirring mold according to claim 1, wherein both side portions of said mold frame are provided with water supply and discharge passages and are extended downwardly in the form of arms and are supported on an oscillation table while communicating said water supply and discharge passages with said first and second water-cooling passages.

5. The electromagnetic stirring mold according to claim 1, wherein said copper plate is integrally joined with said backup frame and extends into the top and is bolted to said mold frame.

* * * * *